US005406819A

United States Patent [19]

Wang et al.

[11] Patent Number: 5,406,819

[45] Date of Patent: Apr. 18, 1995

[54] METHOD AND EQUIPMENT FOR FORMING THE AXLE HOUSING OF AN AUTOMOBILE USING AN INTEGRAL STEEL TUBE

[76] Inventors: Xiandong Wang, Si Daogou, Zhen An Dist.; Du Bian, Education Bureau, Bldg.One-618, Zhen Ba St., Zhenxing Dist., both of Dan Dong, Liaoning Prov., PRC, China

[21] Appl. No.: 998,722

[22] Filed: Dec. 30, 1992

[30] Foreign Application Priority Data

Dec. 31, 1991 [CN] China ..... 91111942.6

[51] Int. Cl.[6] ..... B21D 53/90

[52] U.S. Cl. ..... 72/68; 72/367

[58] Field of Search ..... 72/68, 74, 117, 122, 72/367, 392

[56] References Cited

U.S. PATENT DOCUMENTS 1,548,756 8/1925 Scott ..... 72/392

1,652,630 12/1927 Mogford et al. ..... 72/367

1,958,215 5/1934 Spatta ..... 72/392

3,290,914 12/1966 Vaill et al. ..... 72/117

*Primary Examiner*—Lowell A. Larson

*Attorney, Agent, or Firm*—Burns, Doane, Swecker & Mathis

[57] ABSTRACT

The invention relates to a method for forming and manufacturing the automobile rear axle housing from an integral steel tube, and to the special equipment for using the said method. The method involves cutting a longitudinal through opening in the center of the steel tube, expanding the opening with an expanding device and after expansion, roll-pressing or pressing the tube wall into the required form. The equipment designed for using this method comprises an operable die set, tube end thrust unit, opening expansion unit, roll-press unit and press unit. The use of this invention for making the automobile rear axle housing will omit the welding process, improve product quality, reduce manufacturing cost and the investment for equipment.

15 Claims, 11 Drawing Sheets

Fig. 1
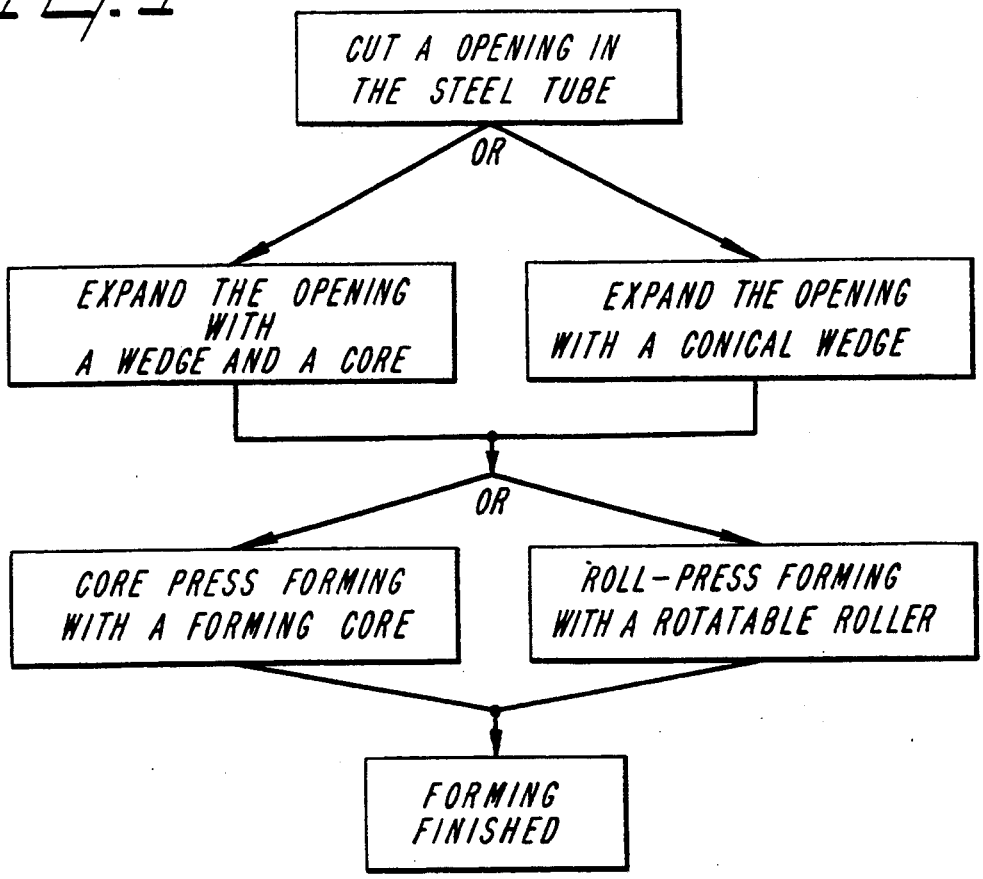
Fig. 2
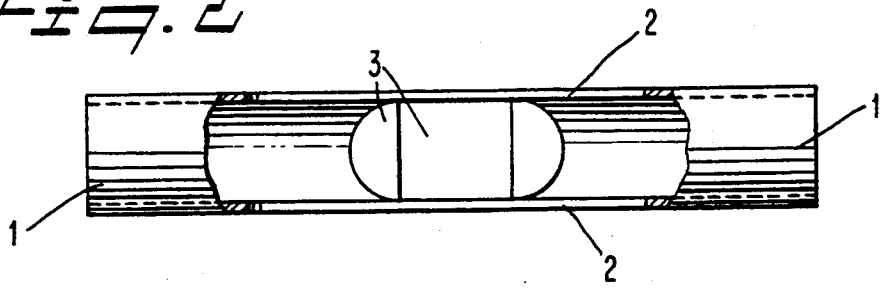
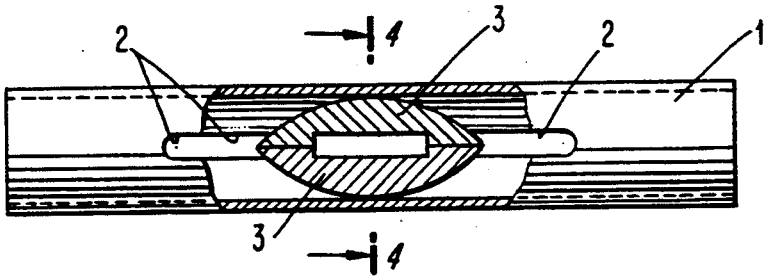
Fig. 3
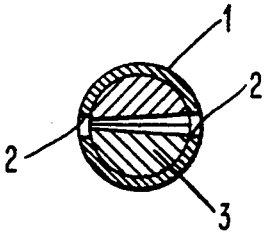
Fig. 4

41
40
42
30
32
35
34
37
37
17
17
21'
50
56
55
64"
54
K
12
60
64'
21
21
57
62'
13
62"
61
63
11

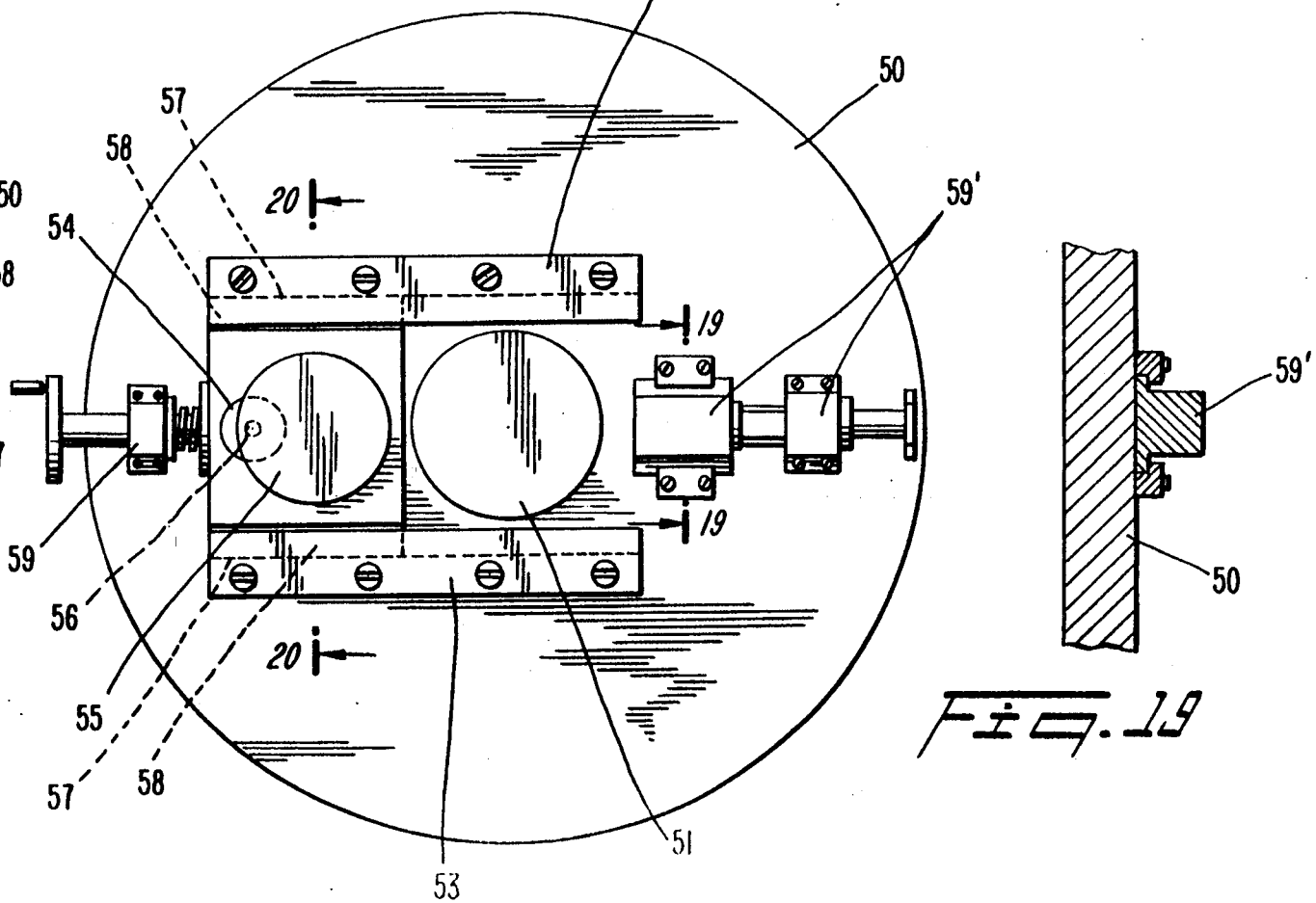
FIG. 18
FIG. 19
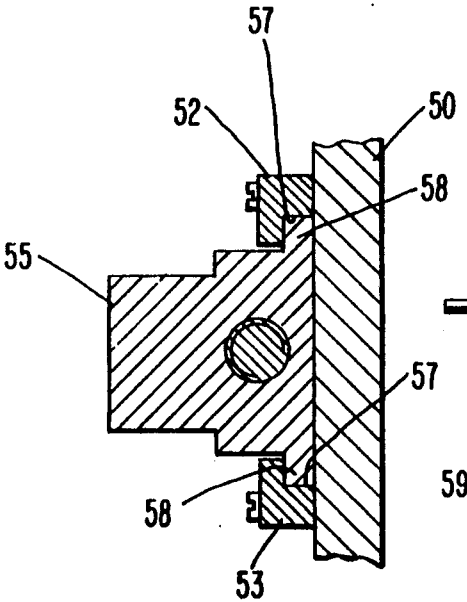
FIG. 20

METHOD AND EQUIPMENT FOR FORMING THE AXLE HOUSING OF AN AUTOMOBILE USING AN INTEGRAL STEEL TUBE

This invention relates to a method for making the rear axle housing of an automobile, in particular, to a method for forming the rear axle housing of an automobile using a single integral steel tube and a set of special equipment by means of which the axle housing is formed.

At present, there are two methods of making the axle housing of an automobile: one is:casting and the other stamping-welding. The cast rear axle housing of an automobile is the earliest structure adopted, which has the drawbacks of heavy weight, stringent technical requirements and casting faults that are difficult to control. Therefore the stamping-welding process is finding more and more application in manufacturing the rear axle housing of an automobile both at home and abroad. In using this method, a pair of upper and lower half housings are made by stamping steel plates into form, and then welded into one body. Alternatively, another kind of stamped-welded structure consists of right and left steel tubes, which are first machined into form separately and then welded together to become the axle housing. Although these housings are made of steel plates and welding work involved is relatively less they are still of welded structure. Compared with the cast structure, the stamped-welded rear axle housing of an automobile is light in weight. However, strict requirement is imposed on welding quality, because welding quality is critical to the quality of the housing. Therefore, sophisticated technology is involved and in most cases a special welding production line is needed, which takes a large fund to set up and hence the cost of the finished product.

The purpose of this invention is to provide a method for forming the rear axle housing of an automobile using a single steel tube, and a special equipment to implement the method.

The details of the method in accordance with the present invention of forming the axle housing using a single steel tube are as follows:

1. Select the steel tube and its diameter and wall thickness for making the housing in accordance with the design requirements.

2. Make a narrow straight opening in the middle of the steel tube along its axis, the length of this opening being determined by the required diameter of the formed housing, i.e., the length of the opening being :such that it can be expanded to an axle housing with the required diameter.

3. Expand the narrow opening of the tube so that the external wall of the tube on either side of the opening reaches or approaches the diameter of the axle housing required. To expand:

Insert two halves of an expansion core into the opening of the steel tube, drive in a wedge between the two half cores to push them transversely so that the steel tube expands;

Drive in a conical wedge directly into the opening of the steel tube to make it expand, preferably drive in the conical wedge when it is rotating at medium or low speed;

Preferably the expansion of the opening of the steel tube is done when the steel tube is placed in a die set so that a good form, that is, a form that conforms to the design requirements as much as possible will be acquired for the axle housing and that the final forming of the housing will be facilitated.

4. After expansion is completed, place the steel tube in the forming die set to press-form the expanded tube walls.

Insert two halves of a core into the expanded tube, drive in a wedge between the two halves, which, under the action of the wedge, and operating with the external forming die, press the tube walls into the shape required for the axle housing by the design.

Use a rotating press roller for forming, that is, place a rotatable press roller into the expanded opening of the steel tube, which, operating with the external forming die, roll-presses the tube walls into the form required by the design. When the rotatable press roller is used for forming, the roller should, preferably, roll reciprocally to press and finish the job gradually.

In order to ease the pressing force during expansion and press, increase the speed of expansion and press and ensure the quality of the workpiece being processed, a thrust force may be exercised from the two ends of the steel tube towards its center as the tube is being expanded and pressed to help expand and press form the tube.

FIG. 1 shows the flow of the process in accordance with the present invention.

FIGS. 2, 3 and 4 are diagrams of steel tube 1, opening 2 and the two halves of expanding core 3 placed in the opening, wherein FIG. 3 is the top view of FIG. 2 and FIG. 4 is a sectional view of FIG. 3 taken from A—A.

FIGS. 5, 6 and 7 show the opening of steel tube 2 and the core 3 and wedge 40 used in expanding the tube in accordance with the invention, wherein FIG. 6 is the top view of FIG. 5 and FIG. 7 is a sectional view of FIG. 6 taken from B—B.

FIGS. 8 and 9 show steel tube 1 placed in die set 60 and core 3 and wedge 40 used to expand the opening 2 of the steel tube in accordance with the invention.

FIGS. 10, 11 and 12 show the rotatable press roller 54 used to roll-press the wall 9' of the expanded opening of the steel tube in accordance with the invention, and wall 9 of the opening has a finished form, wherein FIG. 11 is the top view of FIG. 10 and FIG. 12 is a sectional view of FIG. 11 taken form H—H.

FIGS. 13 and 14 show the steel tube placed in die set 60, two halves of a core 8 placed in the expanded opening of the steel tube and the wedge driven in to act on the core 8 to press the wall 9' of the opening into form in accordance with the invention.

FIGS. 15 and 16 are diagrams of the structure of the special equipment for forming and manufacturing the automobile axle housing out of an integral steel tube in accordance with the present invention, wherein FIG. 16 is the left side view of FIG. 15.

FIG. 18 is a view of FIG. 16 in K direction.

FIG. 19 is a sectional view of FIG. 18 taken along E—E.

FIG. 20 is a sectional view of FIG. 18 taken along D—D.

Figure 5:
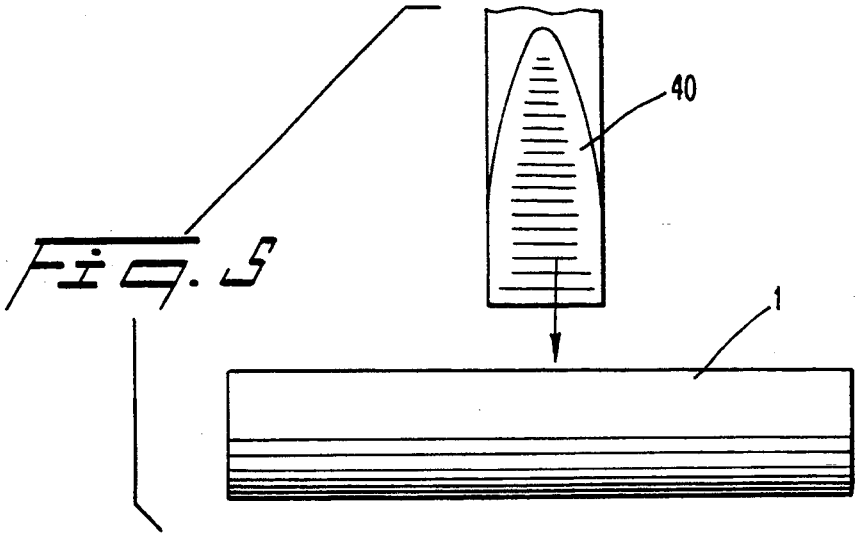
Figure 6:
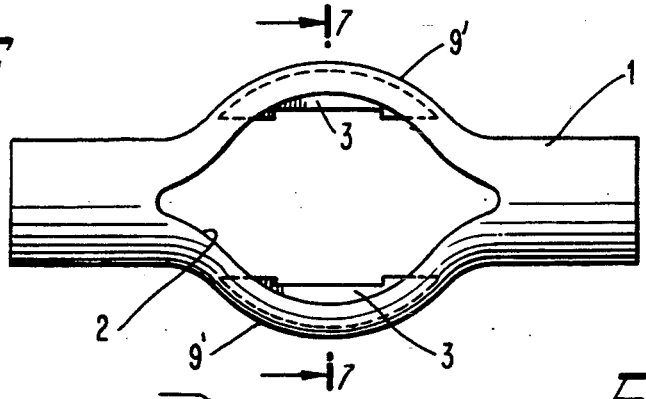
Figure 7:
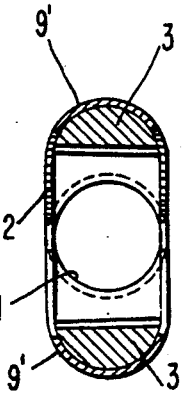
Figure 10:
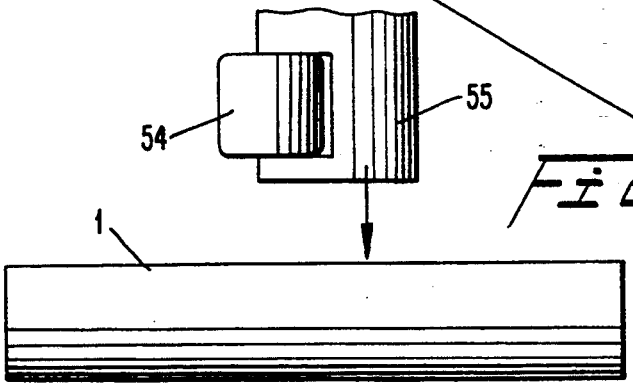
Figure 11:
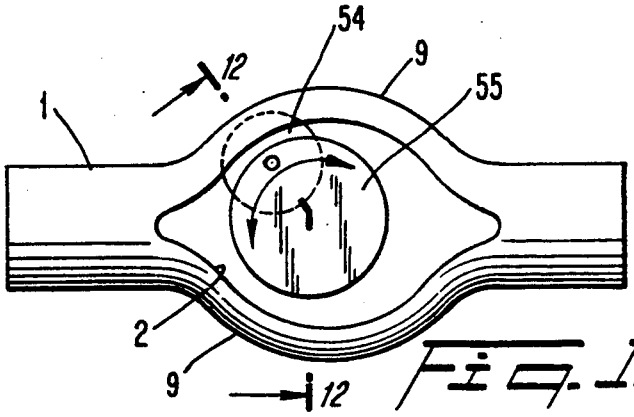
Figure 12:
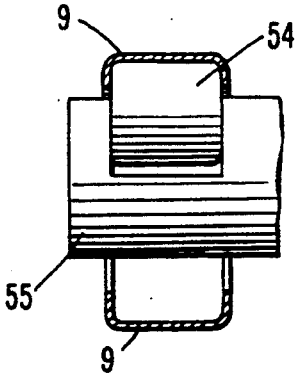
Figure 8:
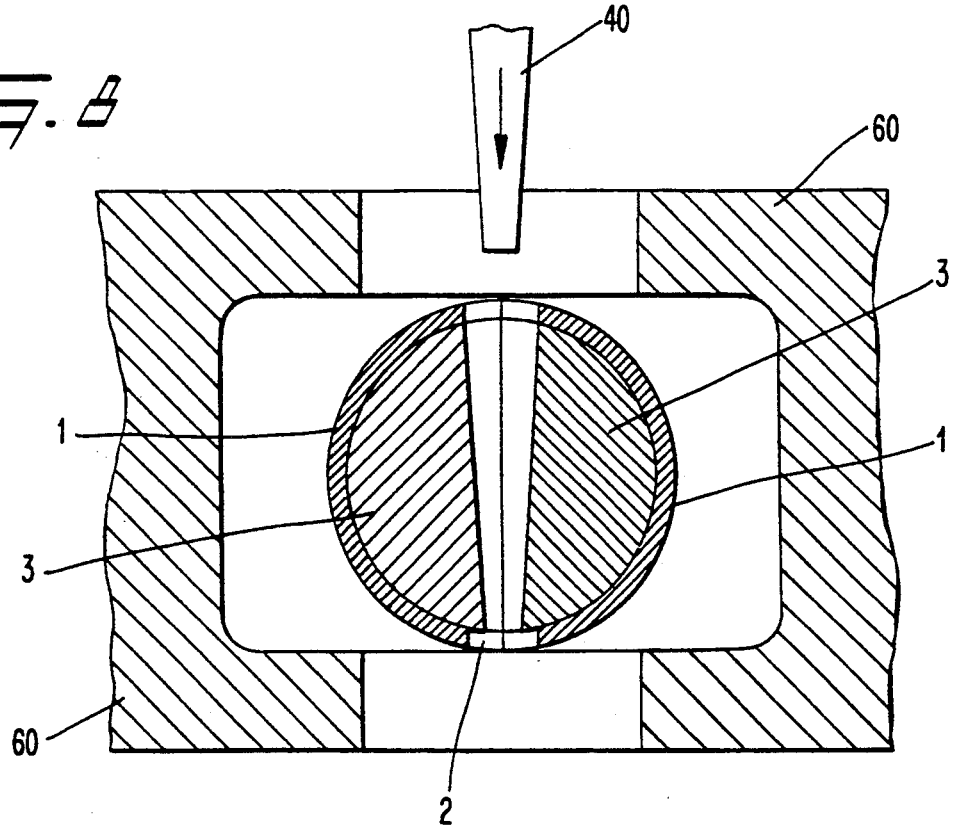
Figure 9:
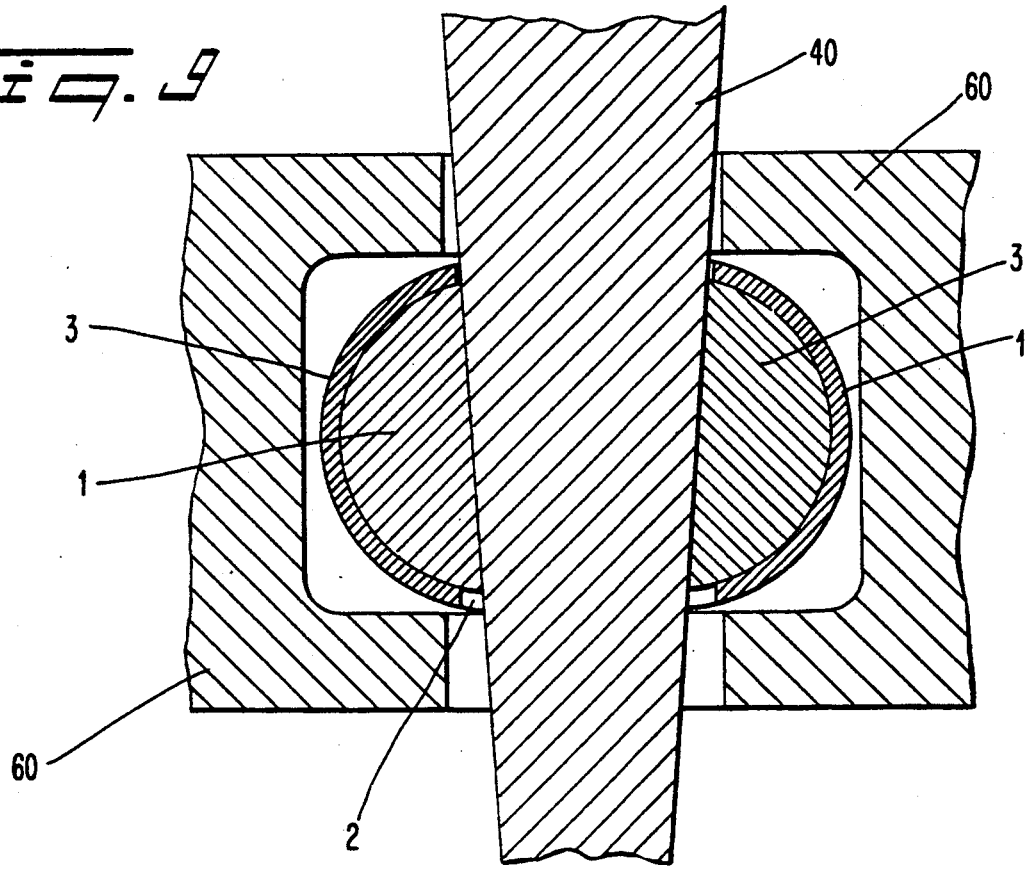
Figure 13:
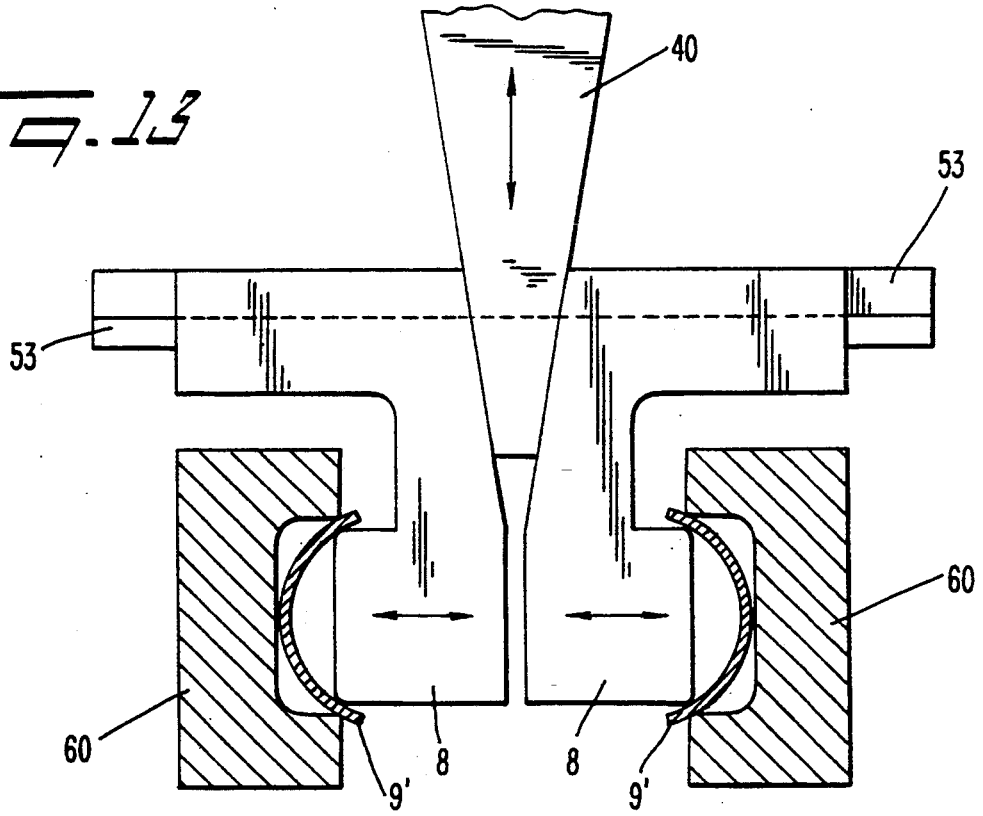
Figure 14:
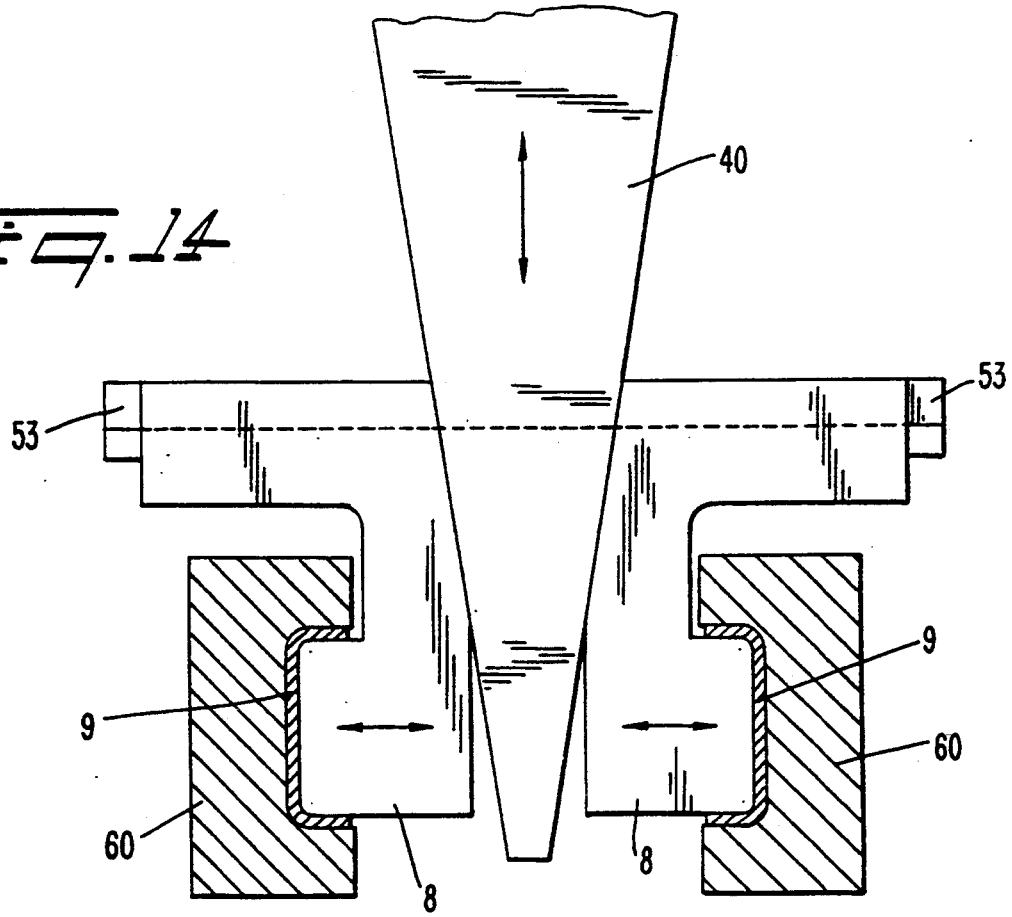

As described above, the present invention relates to a method of forming the axle housing by using an integral steel tube, by which the opening 2 of the steel tube is expanded and the opening wall 9' is pressed and/or roll-pressed into the required form, and preferably, steel tube 1 is placed in the same die set, the forming die set 60, that is, steel tube 1 is placed in the external forming die set when the opening 2 of the steel tube is being expanded.

In accordance with the above-mentioned method of forming the automobile axle housing using an integral steel tube, the special equipment provided by this invention for forming the axle housing using an integral steel tube includes a machine body, a drive head, and the axle housing forming die set. The machine body comprises a base, a work platform which is the upper surface of the base, with an upright post fixed to one end of the platform for mounting the drive head. The drive head means is movably mounted on the upright post of the machine body by means of an overhanging arm in such a way that it is located right above the work platform. Between the overhanging arm and the upright post of the machine body is the drive mechanism, which enables the overhanging arm i.e. the drive head to move up and down to adjust its position. The drive head consists of a conical rod and a drive transmission mechanism which enables the conical rod to move up and down reciprocally and rotate. The forming die set for the axle housing is placed on the work platform of the machine body, and the conical rod on the drive head is used to expand and form the steel tube having the opening placed in the forming die set.

A further description is given below with the help of these figures for the special equipment for forming-and manufacturing the automobile axle housing out of an integral steel tube in accordance with the present invention.

The special equipment in the invention consists of machine body 10, a drive head 20 and the forming die set 60 mounted on the machine body.

The machine body 10 includes base 11 and the upright post 12, the upper surface of the base 11 is the work platform 13, at one end of which the upright post 12 is fixed stationarily.

The drive head 20 comprises the overhanging arm 21, the mechanism for adjusting the position of the overhanging arm 21 on the upright post of the machine body, sleeve spindle 30, the transmission mechanism enabling the sleeve spindle 30 to rotate, the conical rod 40 and the transmission mechanism enabling the conical rod 40 to move up and down reciprocally. One end 21' of the overhanging arm 21 is slide-connected to the upright post of the machine body so that the overhanging arm 21 is mounted on the upright post 12 and can slide on it as well; In the figure, the connection and mounting end 21" of the overhanging arm 21 and is in a slot form. By means of the holddown plate 22 fixed at the connection end and engaging the guide 14 of the upright post, the overhanging arm 21 is slide-fixed on the upright post 12. The position of the overhanging arm 21 on the upright post 12 of the machine body can be adjusted by different transmission mechanisms. Such as a lead screw transmission mechanism fixed on the machine body and the overhanging arm. The figures show that a hydraulic cylinder 15 is provided, which is fixed on the top end of the upright post 12 of the machine body, and the rod of cylinder 15 drives the overhanging arm 21. The other end of the overhanging arm 21 is a case structure. The sleeve spindle 30 is fixed on the overhanging arm 21' by means of bearing means. A hydraulic cylinder 41 is fixed on the top of the sleeve spindle 30. A wedge rod 40 is fixed on the rod 42 of the hydraulic cylinder 41 in the sleeve spindle 30. The conical rod 40 is connected to sleeve spindle by means of a slide key 32, which enables the conical rod 40 to be driven up and down reciprocally in sleeve spindle 30 by the rod 42 of the hydraulic cylinder 41 and rotate with the sleeve spindle 30 as well.

The drive mechanism enabling the sleeve spindle 30 to rotate is a gear and rack transmission mechanism or a worm gear transmission mechanism or a gear reduction mechanism fixed on the sleeve spindle 30 and the overhanging arm 21.

Figure 16:
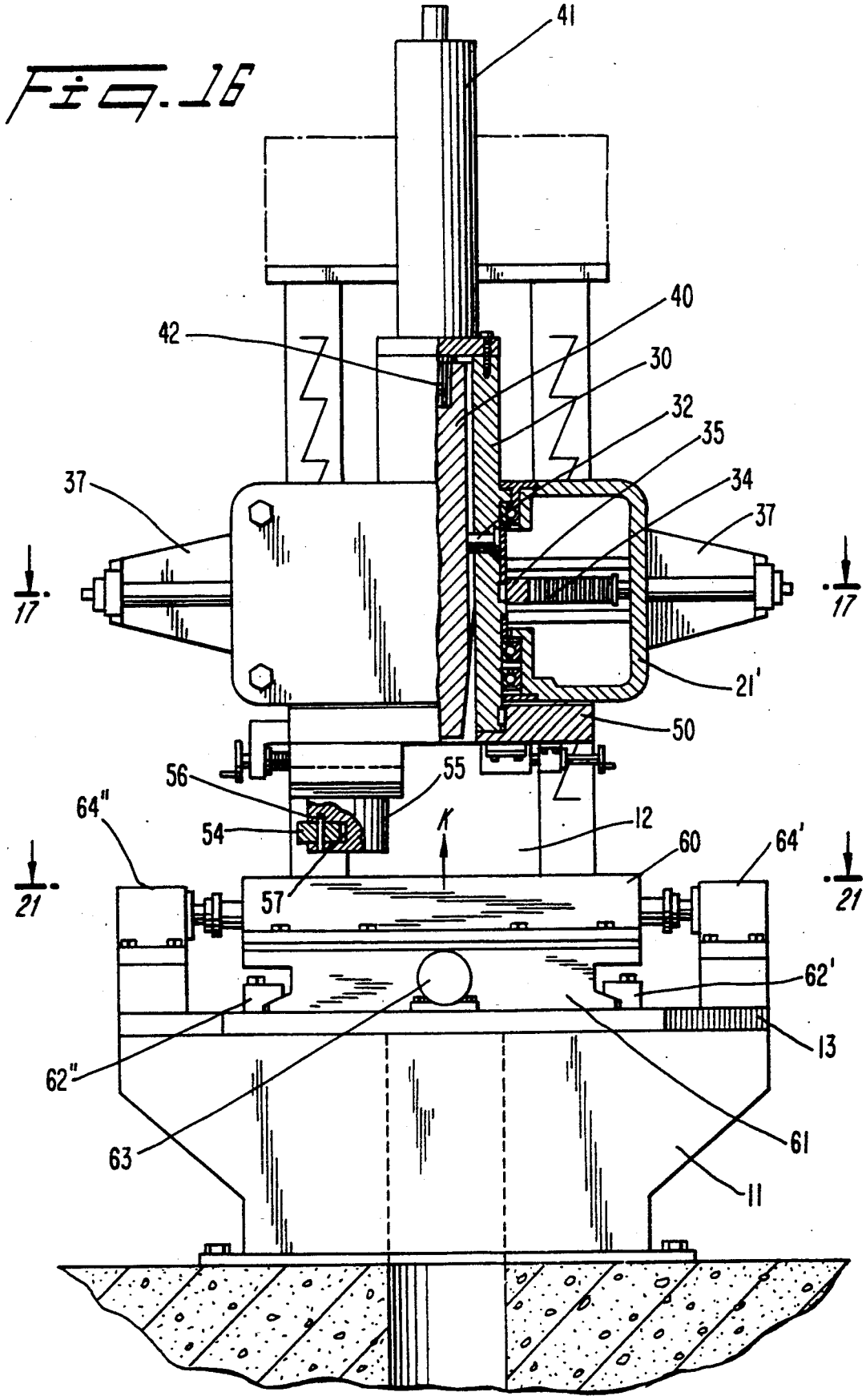
Figure 17:
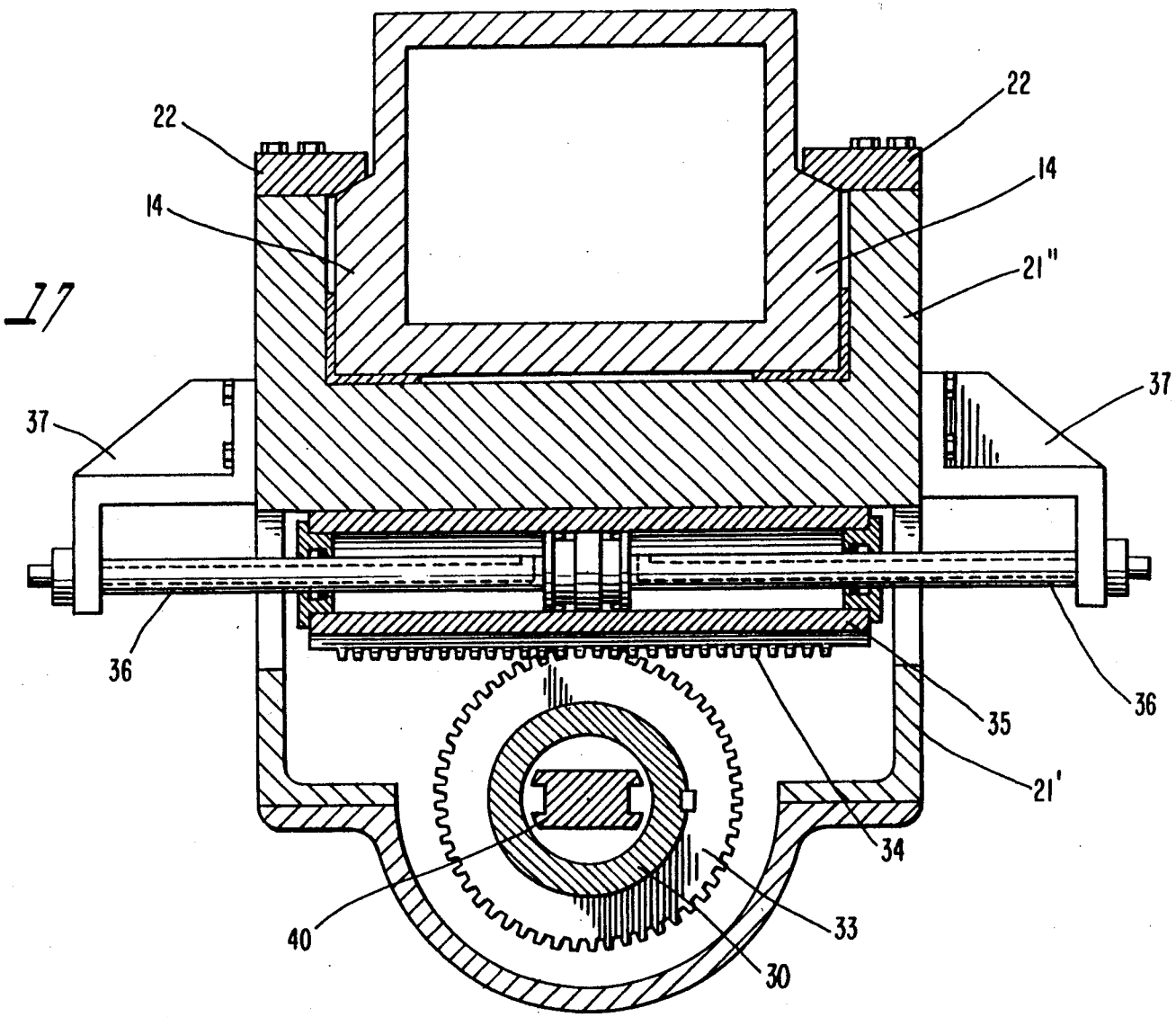
FIG. 17 is a sectional view of FIG. 16 taken from F—F.

FIGS. 16 and 17 show a gear and rack combination transmission mechanism. Gear 33 is fixed stationarily on the sleeve spindle 30. The hydraulic cylinder 35 is fixed on the overhanging arm 21, the hydraulic cylinder 35 being a structure with outer rod at both ends. The rod 36 of the hydraulic cylinder 35 is fixed stationarily on the overhanging arm 21 through a fixed frame 37. However, the body of the hydraulic cylinder 35 is moveable. On the body of the hydraulic cylinder 35 is fixed rack 34, which meshes with gear 33. Rack 34 moves reciprocally with the body of the hydraulic cylinder, driving gear 33 and enabling the sleeve spindle 30 to rotate reciprocally.

Figure 22:
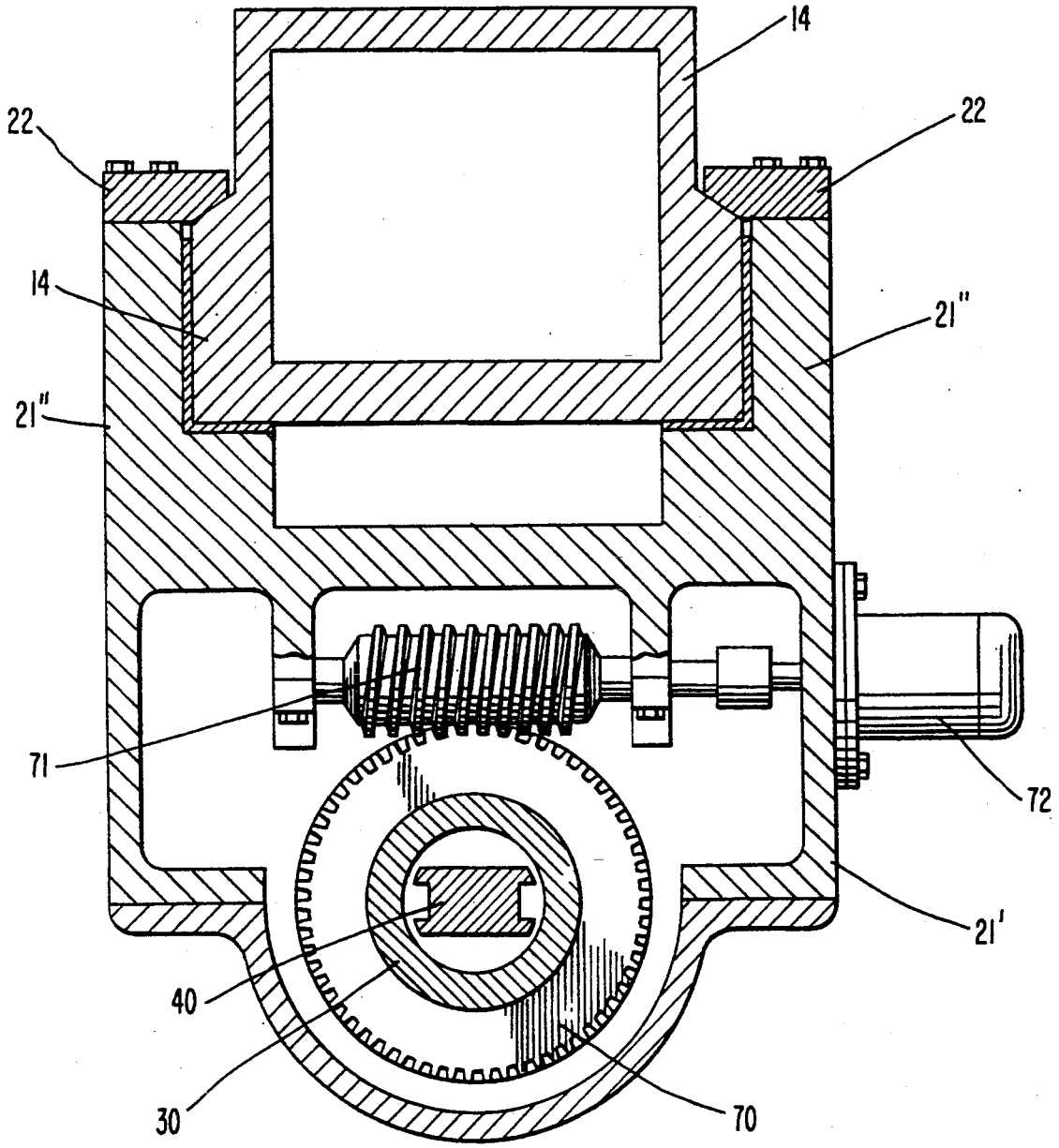
FIG. 22 is a F—F sectional view of FIG. 16 of another embodiment of the invention.

As shown in FIG. 22, wormgear 70 is fixed on sleeve spindle 30 and worm 71 is fixed on overhanging arm 21'. Motor 72 is stationarily fixed on the overhanging wall 21', and enables the sleeve spindle 30 and the conical rod 40 to rotate through the transmission of the wormgear and the worm.

Figure 23:
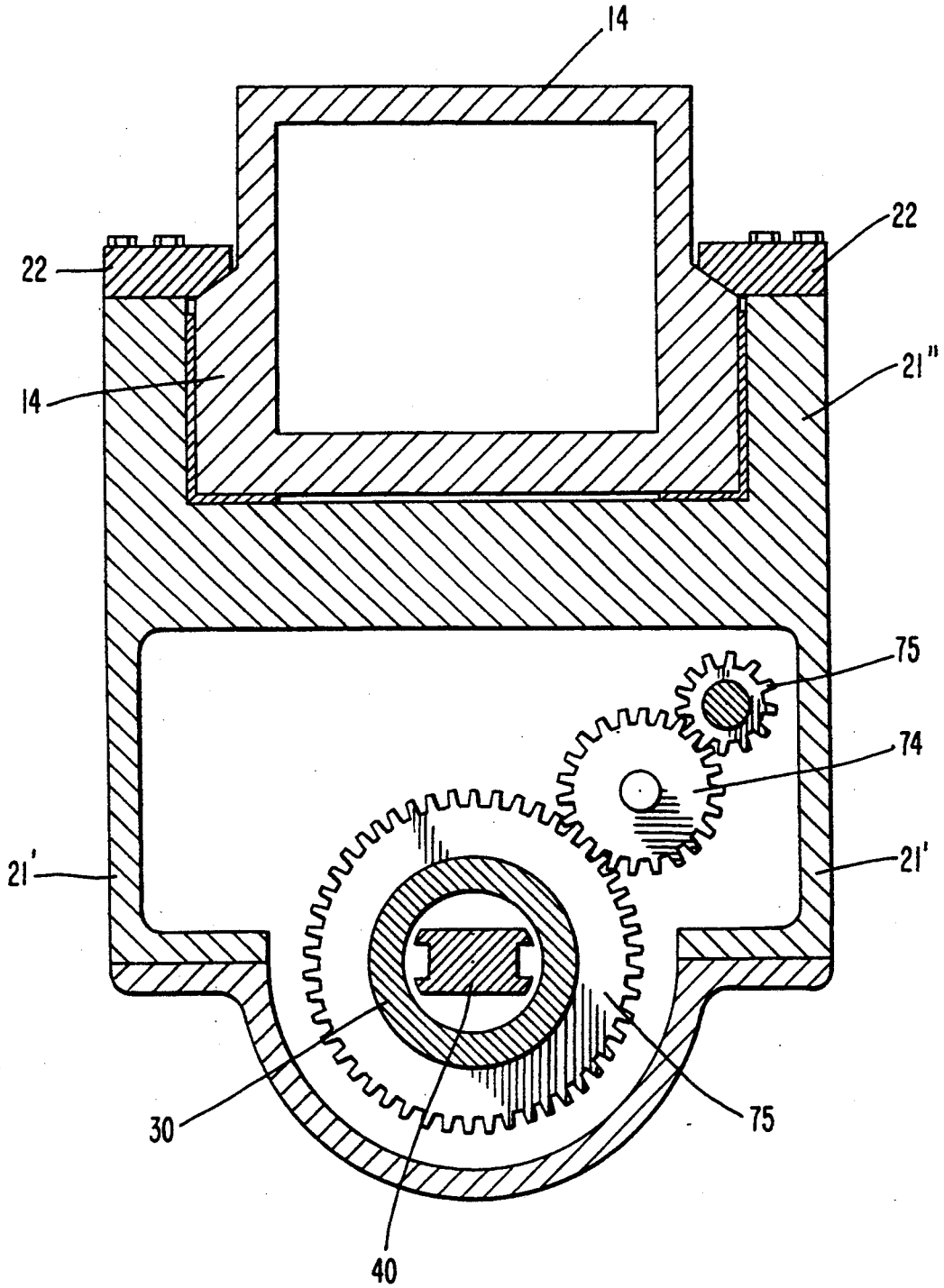
FIG. 23 is a F—F sectional view of FIG. 16 of yet another embodiment of the invention.

As shown in FIG. 23, gear 73 is stationarily fixed on the sleeve spindle 30 and transmission gear 74 is fixed on the overhanging arm 21'. The motor-driven gear 75 is stationarily fixed on the overhanging arm 21' and enables the sleeve spindle 30 and the conical rod 40 to rotate via the gear reduction mechanism.

Figure 15:
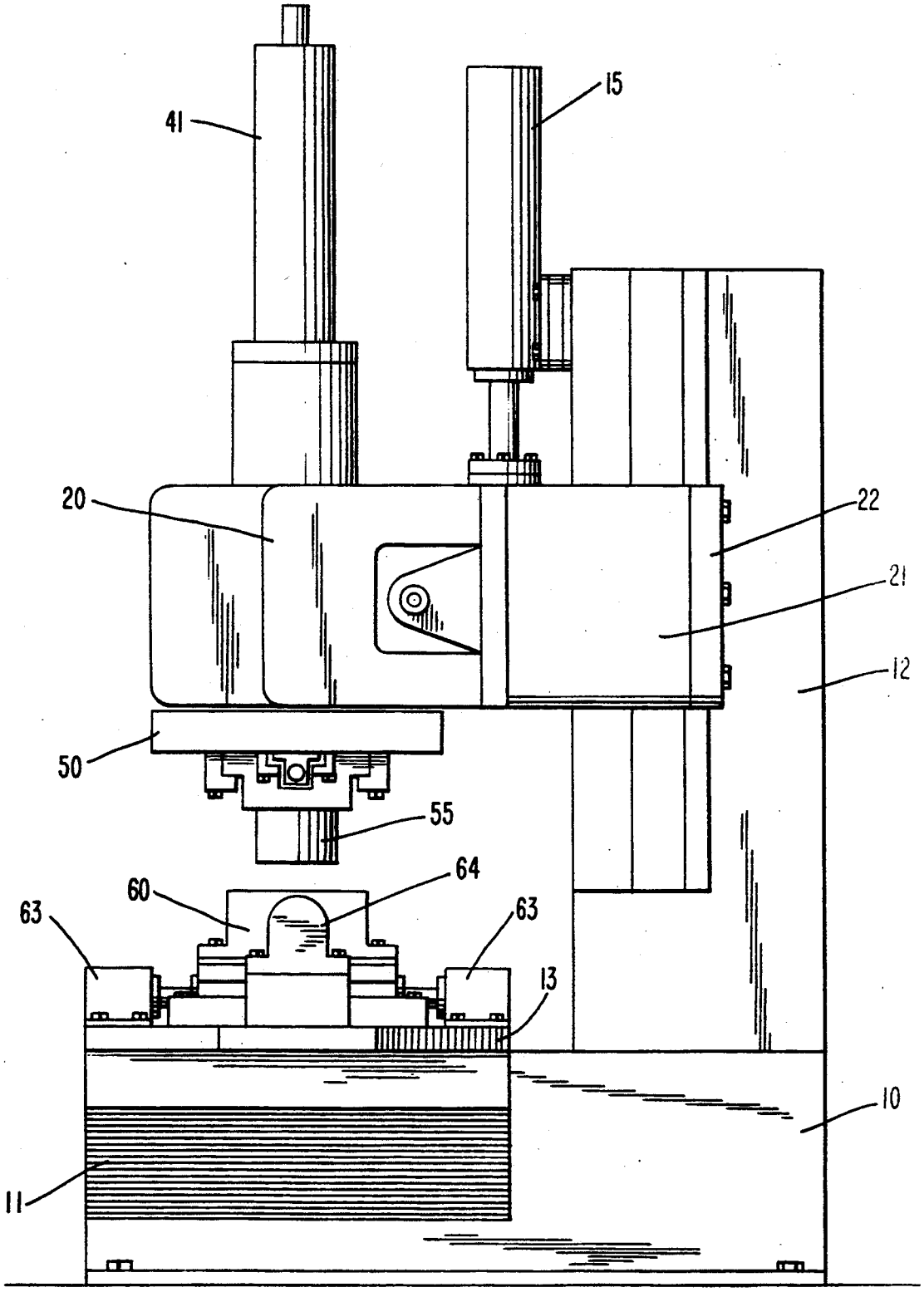
Figure 21:
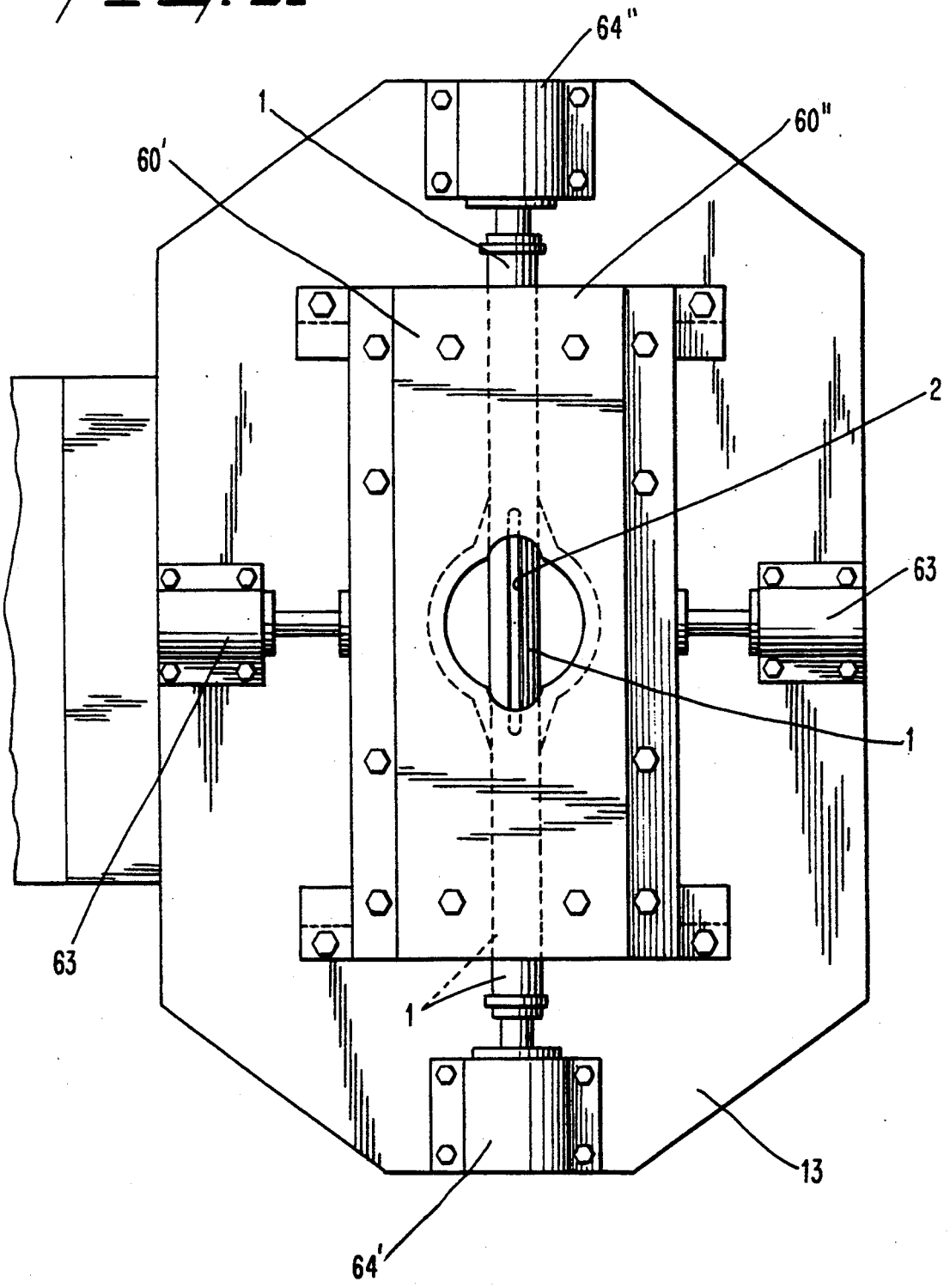
FIG. 21 is a sectional view of FIG. 16 taken along C—C.

The die set for forming a steel tube into an axle housing is placed on the body of the machine. The die set consists of a die 60 and the device for opening and closing the die 60, both components being placed on the work platform 13 of the machine body. The die comprises two halves which can be opened. By means of guide rail, the die is slide mounted on the work platform 13. The device that opens and closes the die 60 is a hydraulic cylinder or a lead screw structure fixed stationarily on the work platform 1.3, which drives the die 60 and makes it move along the guide rail on the work platform 13 to complete the opening and closing of the die. The two halves 60' and 60" of the forming die 60 are both moveable or one half fixed on the platform and the other half moveable. To be concise, no separate description will be given of the two structures in this paper. As shown in FIGS. 15, 16 and 21, the guide rail for mounting the die consists of holddown plates 62' and 62". Stationarily fixed on the work platform 13. The guide rail can certainly be a trapezoidal or dovetail slot cut in the work platform 13. The die 60 should, preferably have a base 61 tightly fixed with screws, and by means of this base 61 engage the guide rail of the work platform 13, and is enabled to move along the guide rail by the hydraulic cylinder 63, which is the device that opens and closes the die 60.

To permit the application of a thrust force at the two ends of steel tube 1 in the direction of the tube's longitudinal axis while the tube is being expanded to aid the expansion of the tube opening 2 in accordance with the present invention, a pair of expansion auxiliary hydraulic cylinders 64' and 64'' for pushing and compressing steel tube 1 are fixed stationarily at the two ends of the forming die set 60 on the work platform 13.

To permit coil-press forming by using a rotatable roller mentioned above on the manufacturing equipment for forming the axle housing from an integral steel tube in accordance with the present invention, a chuck 50 is stationarily fixed at the lower end of sleeve spindle 30, with a central opening 51 in its middle part for the conical rod to pass through. On chuck 50 is slide connected by a guide rail structure a press roller unit comprising a roller and a stud. As shown in FIGS. 15, 16, 18, 19 and 20, the guide rail on the bottom of chuck 50 may be composed of plates 52 and 53 fixed stationarily on chuck 50, or formed by a trapezoidal or dovetail slot cut directly in the bottom of the chuck. The press roller unit for roll-press forming comprises press roller 54 and the roller stud 55. At the lower end of the roller stud 55, a radial slot 57 perpendicular to the axis of the stud is cut, and in slot 57 is placed the press roller 54, which is rotatably fixed on the roller stud 55 by a pivot 56. On the upper end of the roller stud there is a protruding edge 58, by means of which the roller stud 55 is slide fixed on the guide jail of chuck 50 and can move thereon. The position of the hydraulic press forming roller set in the guide rail on the chuck is adjusted by a positioning device fixed on chuck 50, which is composed of lead screw transmission mechanisms 59 and 59'.

The use and the operation of the said equipment is described as follows. Steel tube 1 with opening 2 is placed in the forming die set 60, which is closed by means of the hydraulic cylinder 63. The position of the overhanging arm 21 is adjusted by means of the hydraulic cylinder 15. The wedge/conical rod 40 is made to move downwards by the hydraulic cylinder 41 and expands the opening 2 of steel tube 1. Then, the conical rod 40 moves up. The two halves of the core 8 are placed in the axle housing 9' made of the expanded steel tube 1 and the wedge 40 is again made to move down and enter the core 8, which press the steel tube wall 9' into the final required shape; or after completion of the expansion of opening 2 of steel tube 1, the lead screw transmission mechanisms 59 and 59' on chuck 50 are used to drive the press roller stud 55 of the hydraulic forming set to the central position of chuck 50, and then the overhanging arm 21 is lowered to enable the press roller 54 to accurately enter the axle housing 9' of steel tube 1. The power transmission unit—the worm-gear mechanism/hydraulic cylinder 35 is started to make the sleeve spindle to rotate reciprocally within a range not less than 360 degrees. Chuck 50 rotates with sleeve spindle 30. The lead screw transmission unit 59' is used to adjust the offset between the roller stud 55 and the axis of sleeve spindle 30, that is, the press to fultill the feed of roller 54 for roll press. The press roller stud 55 rotates reciprocally with the turning chuck and the press roller 54 is used to roll-press steel tube wall 9' to the required shape.

The present invention features a simple technical process, which not only dispenses wit the welding process in manufacturing the automobile axle housing, but also improves product quality, reduces production cost and the expense required for purchase of equipment. The special equipment of the invention has powerful functions and operates with high efficiency. The present invention provides a good method and a new equipment for manufacturing the automobile axle housing.

We claim:

1. A method of forming an axle housing, comprising the steps of:

selecting an integral steel tube having a longitudinal axis;

forming an elongated opening along the longitudinal axis, a length of the elongated opening being determined by a diameter of the axle housing;

inserting an expansion core in the elongated opening;

adjusting a position of a drive head mounted on an upright post over said steel tube, said drive head including a sleeve spindle and a rod movable up and down within said sleeve spindle;

using a hydraulic cylinder to move said rod down into the expansion core so as to expand the elongated opening in said steel tube until an external wall of the steel tube approaches dimensions required for the axle housing;

placing the steel tube in a die set; and press forming the opening of the steel tube into a final shape.

2. The method of claim 1, wherein the step of expanding the opening includes applying a compressive force at each end of the steel tube while driving the rod.

3. The method of claim 1, wherein the step of press forming the opening includes:

placing a rotatable press roller into the expanded opening; and operating the press roller with the die set to roll press the tube wall into a required form.

4. The method of claim 3, wherein the step of press forming the opening includes applying a compressive force at each end of the steel tube while operating the press roller.

5. The method of claim 1, further including placing the steel tube in an external die set when the elongated opening is expanded.

6. The method of claim 1, further including placing the steel tube in an external forming die set when the elongated opening is expanded.

7. An apparatus for forming an axle housing, comprising:

a main body having a base;

an upper surface of the base forming a work platform;

an upright post stationarily fixed to the work platform;

a drive head mounted to said upright post;

an overhanging arm connecting said drive head to said upright post;

means for adjusting the position of said drive head on the upright post;

a rod mounted in said drive head to move reciprocally within said drive head;

a forming die set mounted on said work platform, said die set includes two openable halves and is slidably fixed on the work platform by guide rails;

hydraulic means fixed on the work platform for opening and closing the die set;

a sleeve spindle mounted in said drive head, said rod being mounted within said sleeve spindle;

a hydraulic cylinder stationarily mounted to said sleeve spindle;

said rod being connected to said hydraulic cylinder, thus enabling said rod to move up and down and rotationally within said sleeve spindle.

8. The apparatus of claim 7, wherein said rod is conical.

9. The apparatus of claim 7, further comprising a hydraulic cylinder/lead screw mechanism for adjusting the position of the overhanging arm on the upright post.

10. The apparatus of claim 7, wherein said sleeve spindle is fixed to the overhanging arm by means of a bearing.

11. The apparatus of claim 7, further comprising:

a chuck stationarily fixed at a lower end of the sleeve spindle, said chuck including a hole to enable the rod to pass therethrough;

a press roller mounted to a lower end of said chuck; and a roller stud that turns with said chuck;

wherein said chuck rotates with the sleeve spindle.

12. The apparatus of claim 7, further comprising a gear, rack, hydraulic cylinder, and fixing frame for enabling the sleeve spindle to rotate;

said hydraulic cylinder has an outer rod at both ends thereof and is fixed stationarily to the overhanging arm by means of the outer rod passing through the fixing frame;

said rack is stationarily fixed to the hydraulic cylinder and moves reciprocally on the hydraulic cylinder;

said rack meshes with the gear that is stationarily fixed on the sleeve spindle and drives the gear and the sleeve spindle reciprocally.

13. The apparatus of claim 7, further comprising a transmission mechanism for enabling the sleeve spindle to rotate, said transmission mechanism includes a worm-gear fixed stationarily on the sleeve spindle and a worm and a motor fixed on the overhanging arm.

14. The apparatus of claim 7, further comprising a transmission mechanism for enabling the sleeve spindle to rotate, said transmission mechanism includes a motor driven gear reduction mechanism fixed stationarily on the sleeve spindle and the overhanging arm.

15. The apparatus of claim 7, further comprising a pair of hydraulic cylinders mounted on said work platform for pushing at opposite ends of a workpiece to aid its expansion.

* * * * *